US006290367B1

(12) United States Patent
Greenhoe et al.

(10) Patent No.: US 6,290,367 B1
(45) Date of Patent: Sep. 18, 2001

(54) SOLAR RECHARGEABLE LANTERN

(75) Inventors: William J. Greenhoe, Norton Shores; James A. Kramer, Jr., Muskegon; James F. Wolter, Spring Lake, all of MI (US)

(73) Assignee: Light Corp., Grand Haven, MI (US)

( * ) Notice: Subject to any disclaimer, the term of this patent is extended or adjusted under 35 U.S.C. 154(b) by 0 days.

(21) Appl. No.: 09/438,734

(22) Filed: Nov. 11, 1999

(51) Int. Cl.[7] ..... F21L 13/00
(52) U.S. Cl. ..... 362/183; 362/276; 362/802
(58) Field of Search ..... 362/183, 276, 362/802; 307/130, 86

(56) References Cited

U.S. PATENT DOCUMENTS 4,384,317 * 5/1983 Stackpole ..... 362/183
4,481,562 * 11/1984 Hickson ..... 362/183
4,751,622 * 6/1988 Williams ..... 362/183
4,884,017 * 11/1989 Williams ..... 320/102
5,221,891 * 6/1993 Janda ..... 323/350
5,262,756 * 11/1993 Chein ..... 340/332
5,905,356 * 5/1999 Wells ..... 320/101

* cited by examiner

*Primary Examiner*—Alan Cariaso
*Assistant Examiner*—Hargobind S. Sawhney
(74) *Attorney, Agent, or Firm*—Warner Norcross & Judd LLP

(57) ABSTRACT

A rechargeable solar lantern with an improved power control circuit. The power control circuit includes a first switch, actuated by the connection of the solar panel to the battery, to prevent power from being supplied to the light bulb when the battery is charging. The power control circuit also includes a second switch to prevent power from being supplied to the light bulb when the voltage falls below a predetermined unacceptable level. Preferably, the second switch remains tripped until reset by the actuation of the first switch, indicating that the battery is being recharged.

12 Claims, 4 Drawing Sheets

SOLAR RECHARGEABLE LANTERN

BACKGROUND OF THE INVENTION

The present invention relates to battery-powered lanterns, and more particularly to rechargeable battery-powered lanterns.

Battery-powered lanterns are well known and are used worldwide as portable light sources for a wide variety of work and leisure activities. Such lanterns typically include a base and a fixture mounted on the base. One or more light bulbs are supported within the fixture, and a battery is contained within the base to power the bulbs.

As with all battery-powered devices, battery life is a concern. Without a battery tester, determining the remaining life of a battery is difficult. To avoid running out of power, a user either will replace batteries before they are fully used or will carry extra batteries. Particularly in remote areas, extra batteries fill needed space, add weight, and can be hard to procure.

Solar-powered lanterns were developed in part to eliminate the need to replace batteries prematurely and/or the need to carry extra batteries. These solar-powered lanterns include a rechargeable battery in the base and a separate solar panel that can be connected to the lantern to recharge the battery. Unfortunately, solar-powered lanterns suffer several disadvantages. First, when the battery fully discharges, the life of the battery is shortened. Second, full discharge degrades the battery, causing the battery to hold less charge each cycle. Third, the lights within the solar lanterns oscillate or flicker when the battery is weak.

SUMMARY OF THE INVENTION

The aforementioned problems are overcome in the present invention wherein a solar-powered rechargeable lantern includes a power management system to prevent the battery from fully discharging and to prevent the lantern from operating when the battery is charging.

In a first aspect of the invention, the power management system terminates power output to the light bulb when the voltage from the battery drops below a specified level. Preferably, power is not restored to the bulb until the charging circuit is reset. The advantages of this technique are numerous. First, the power management system prevents the battery from fully discharging thereby extending the life of the battery. Second, since a rechargeable battery can build some charge after the power is terminated (i.e. with no load on the battery), the power management system prevents the light from turning back on until the charging circuit has been reset. Third, the termination of power until the charging circuit is reset prevents the light bulb from flickering or oscillating near the end of the battery's cycle. Fourth, power is removed from the lantern control circuitry when the solar panel is connected.

In a second aspect of the invention, the power management system prevents operation of the lantern while the battery is recharging. In the preferred embodiment, the connection of the solar panel to the lantern actuates a switch that prevents the light from being powered. Because the charging current is less than the operating current, this technique prevents the operation of the lantern when there is insufficient power to properly do so.

These and other objects, advantages, and features of the invention will be more readily understood and appreciated by reference to the detailed description of the preferred embodiment and the drawings.

DETAILED DESCRIPTION OF THE DRAWINGS

DETAILED DESCRIPTION OF THE PREFERRED EMBODIMENT

Figure 1:
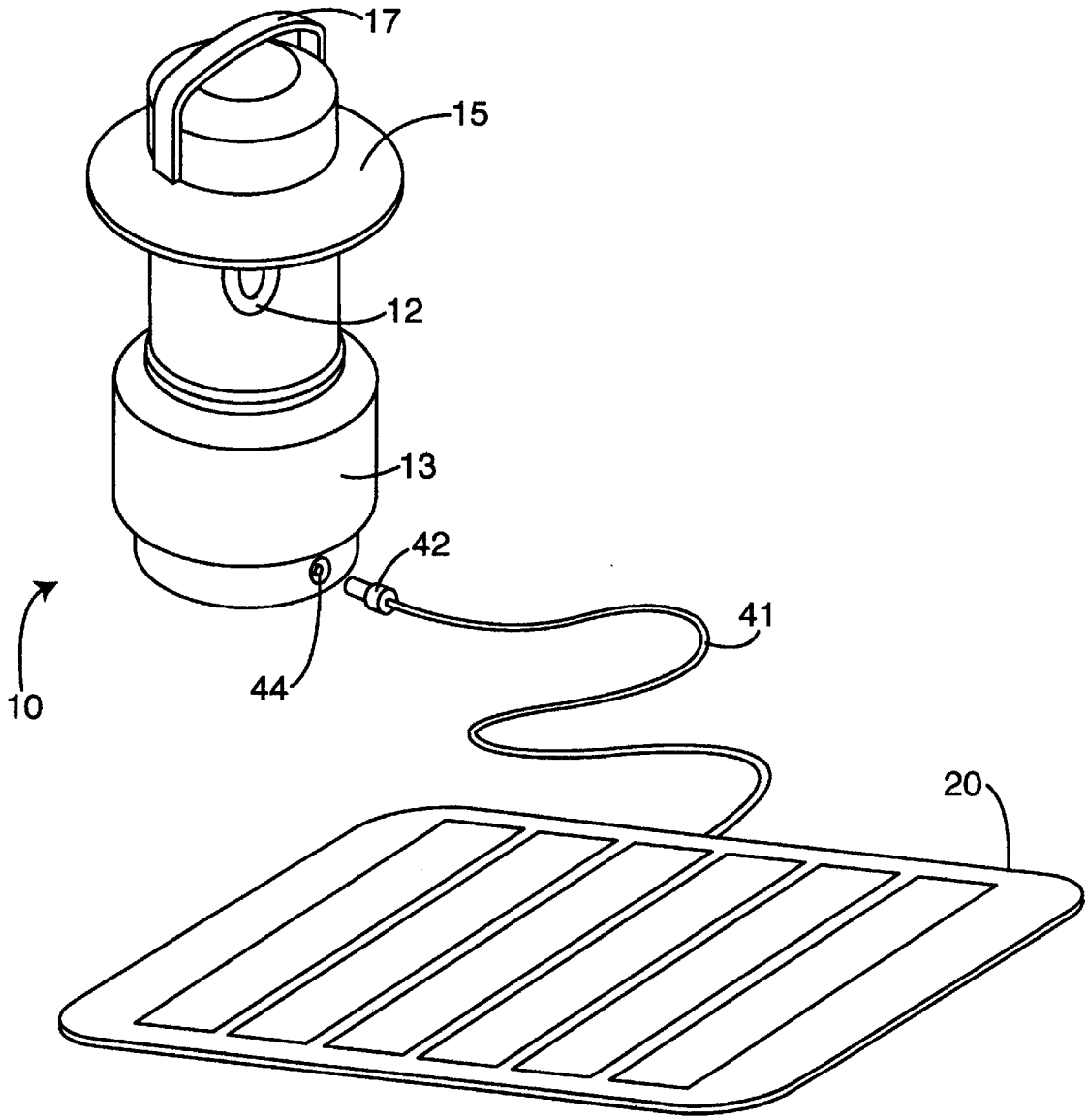
FIG. 1 is a perspective view of the rechargeable lantern of the present invention.
Figure 2:
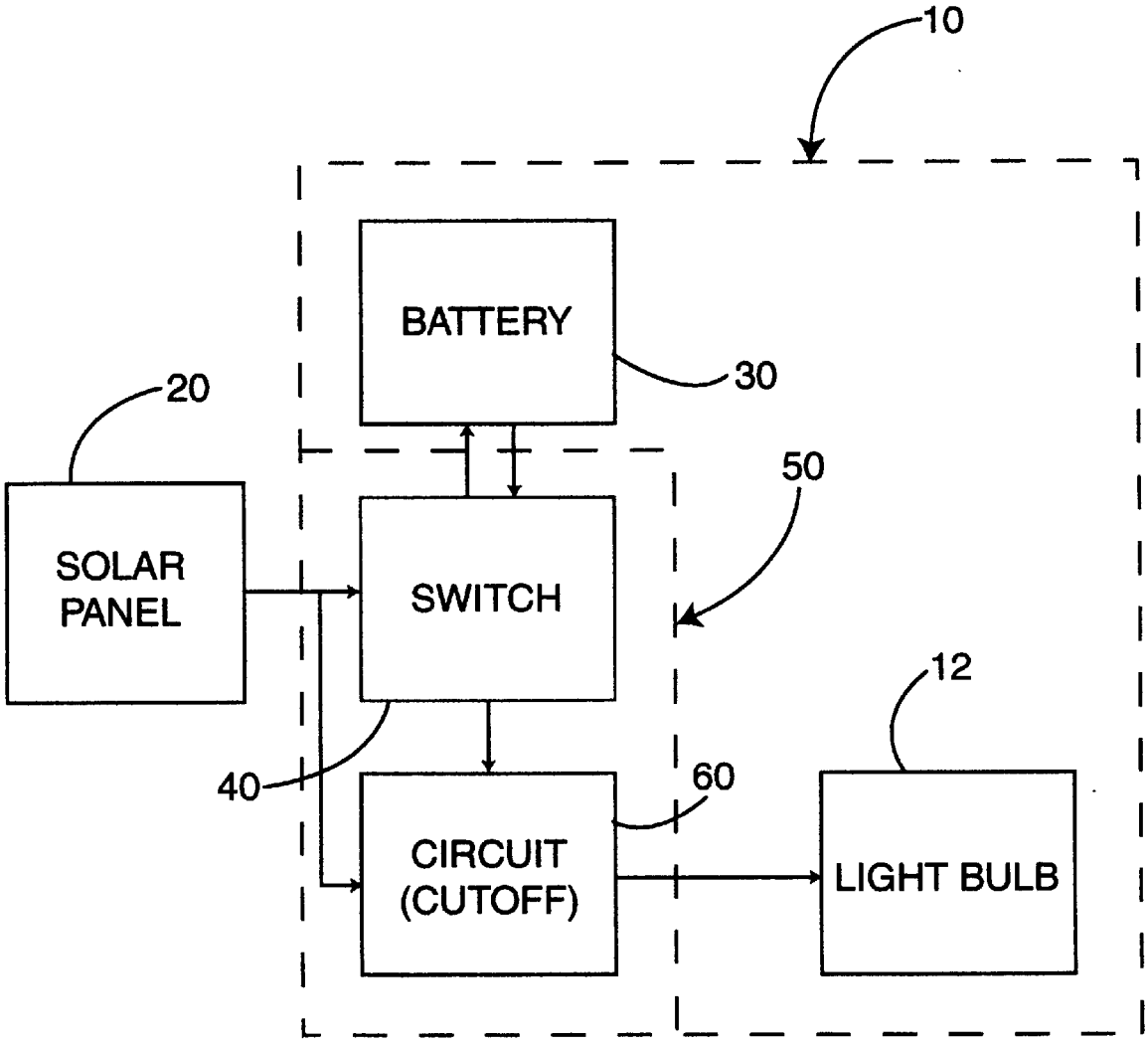
FIG. 2 is a block diagram of the rechargeable lantern.

A solar lantern system constructed in accordance with a preferred embodiment of the invention is illustrated in the drawings and generally designated 1. The system includes a lantern 10 and a solar panel 20. The lantern 10 in turn includes a light bulb 12, a rechargeable battery 30, and a power management system or power control circuit 50. The solar panel 20 can be releasably connected to the lantern 10 to charge the battery 30. The power management system 50 controls the supply of power to the light bulb (1) to prevent operation of the lantern while the battery is charging and (2) to prevent the battery from being drawn below an unacceptably low voltage.

The physical configuration of the lantern 10 is generally well known to those skilled in the art. The lantern includes a base 13, a light housing 15 mounted on the base, and a carrying handle 17 attached to the housing. Each of these components is of a conventional design generally known to those skilled in the art. The base 13 houses the battery 30 and thereby provides a low center of gravity to the lantern 10. A socket 42 is mounted within the base to provide part of a means for releasably interconnecting the solar panel 30 and the lantern 10. The light housing 15 protectively supports the light bulb 12. The carrying handle 17 provides a means of easily grasping and transporting the lantern 10.

The battery 30 can be any rechargeable battery. In the preferred embodiment, the battery 30 is a nickel-metal hydride (NiMH) battery such as those sold by Harding Energy Inc. of Norton Shores, Mich. NiMH batteries eliminate voltage hysteresis effects that progressively reduce NiCD battery capacity over charging cycles. Constant and low discharge rates, as encountered in the present invention, are the worst case for NiCD batteries. Other appropriate rechargeable batteries are and will be know to those skilled in the art.

The solar panel 30 can be any solar panel. In the preferred embodiment, the panel 30 is an amorphous silicon solar electric module sold under the UNI-SOLAR trademark by United Solar Systems Corp. of Troy, Mich. The panel 30 includes a cord 41 terminating in a plug 42, which is releasably or removably received with the socket 42.

Figure 3:
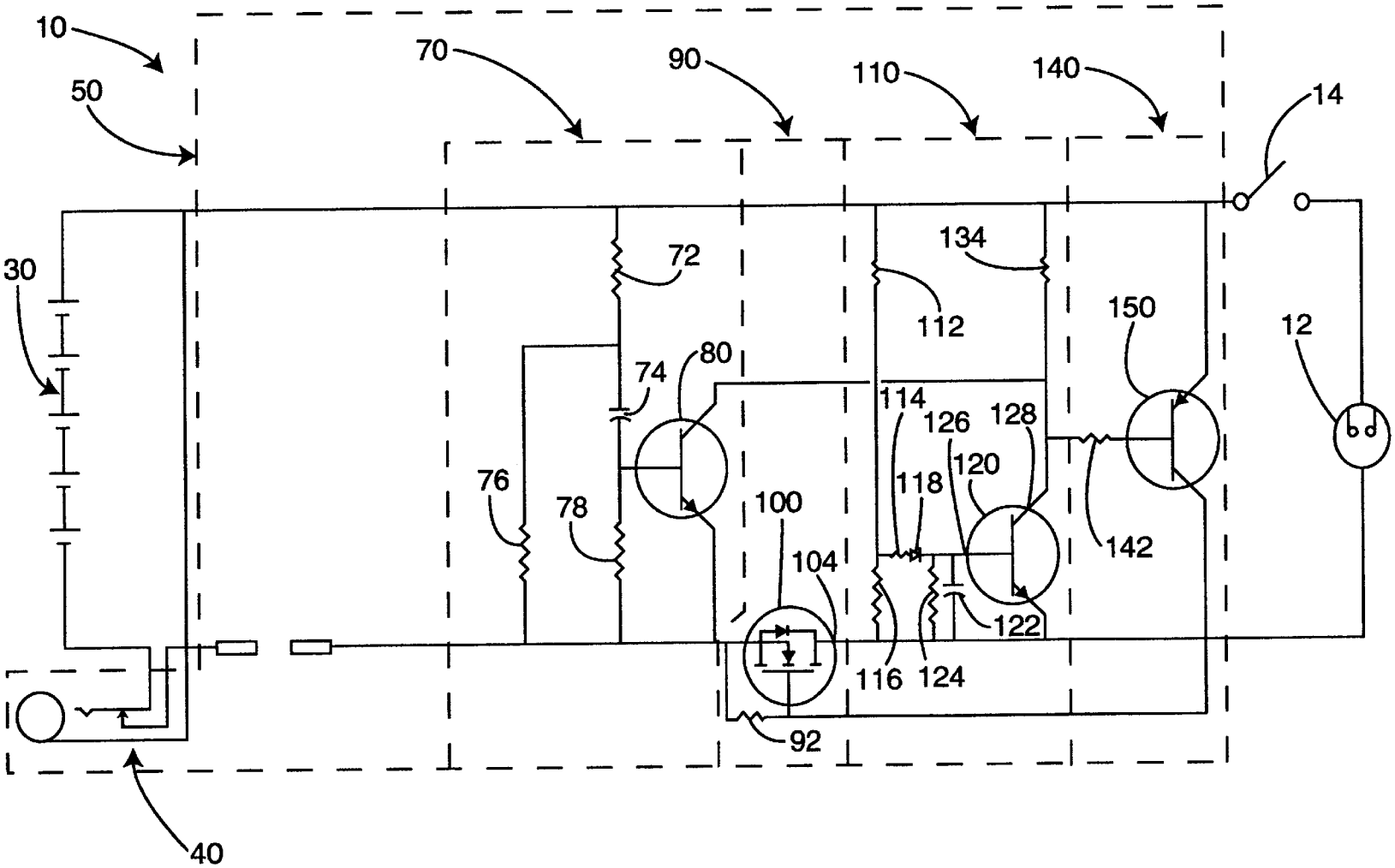
FIG. 3 is a schematic circuit diagram of the power management system.
Figure 4:
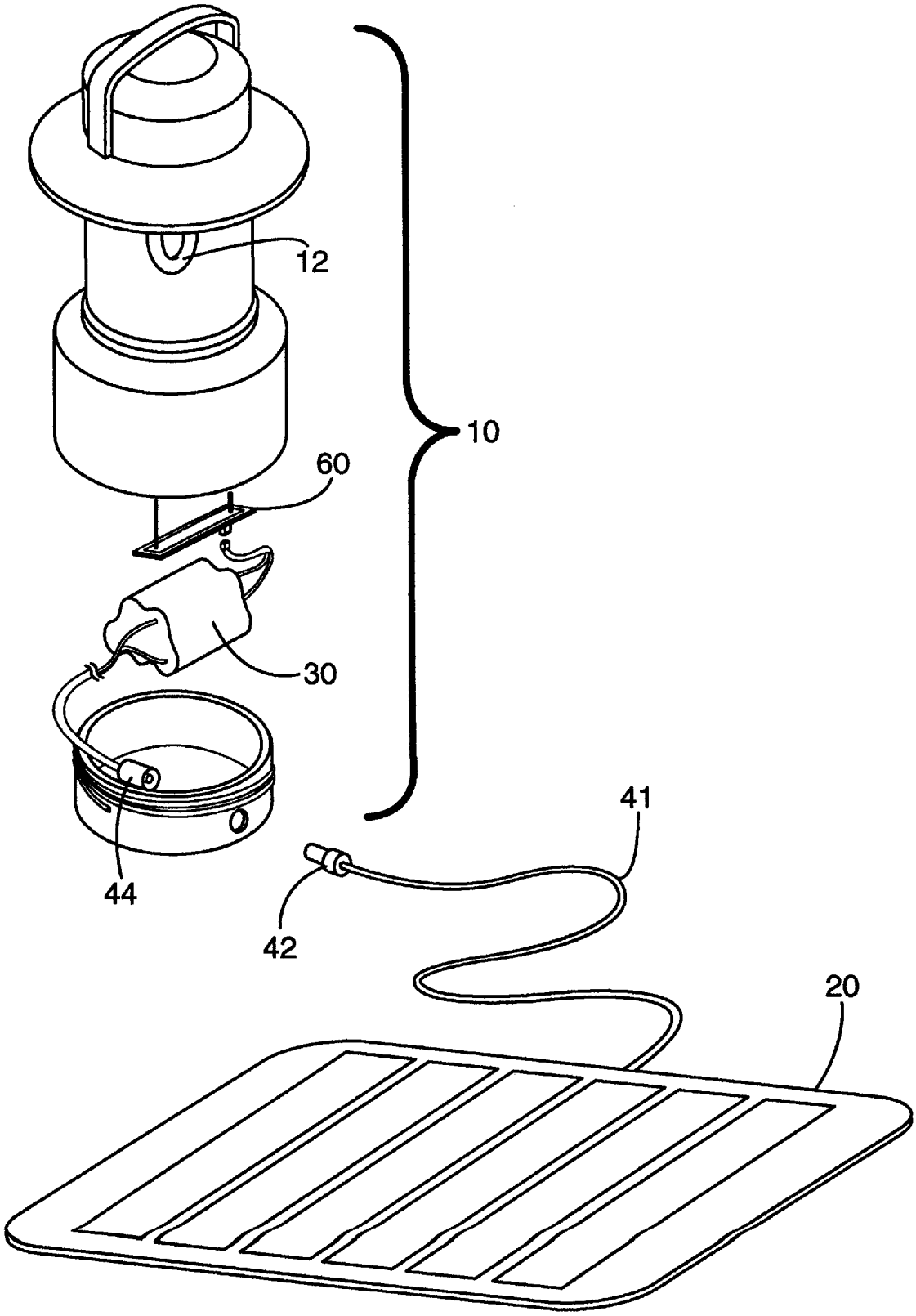
FIG. 4 is a perspective exploded view, similar to FIG. 1 of the lantern.

The power management system 50, schematically shown in FIG. 3, interfaces the light bulb 12 with the battery 30. The power management system 50 contains a circuit 60 which can be divided into four functional parts—the reset 70, the disconnect 90, the shutdown 110, and the level shifter 130.

The shutdown 110 controls when power output to the light bulb should be terminated. The shutdown 110 contains a 191k resistor 112 in series with a 49.9k resistor 116. The level of resistance in these two resistors determines at what voltage should the power output to the light bulb be terminated. The resistors 112 and 116 comprise a voltage divider configuration. The values of the resistors will be selected depending on the desired cut-off voltage. Interconnected between the 191k resistor 112 and the 49.9k resistor 116 are a diode 118 and a 270 ohm resistor 114 leading to the base terminal 126 of the NPN shutdown transistor 120. A 100k resistor 124, and a 0.1 F 25V capacitor 122 connect in parallel between the base terminal 126 of the shutdown transistor 120 and the drain 104 on the disconnect transistor 100. The collector terminal 128 of the shutdown transistor 120 has a 750k resistor 134 between the battery 30 and the collector 128. The shutdown 110 controls the level shifter 140.

The level shifter 140 of the circuit 60 connects with a 100k resistor 142 to the collector 128 on the shutdown transistor 120 and the collector 82 on the reset transistor 80. The level shifter transistor 150 is a pnp transistor. The level shifter 140 is controlled by the shutdown 110, and in turn the level shifter controls the disconnect 90.

The disconnect 90 contains a field effect transistor (FET) 100. The collector 156 of the level shifter transistor 150 is attached to the gate 106 of the FET 100. The gate 106 controls the FET 100 and terminates power between the light bulb 12 and the battery 30 when the voltage at the gate 106 is zero. The gate 106 allows voltage to pass between the source 102 and the drain 104 when the level shifter 150 applies a positive voltage to the gate 106 on the FET 100. A 150k resistor 92 is located between the gate 106 and the battery 30.

The reset 70 includes a 100k resistor 72, a npn transistor 80, a 100k resistor 78, and a 1M resistor 76 which is in parallel with a 0.1 F 25V capacitor 74. The NPN reset transistor 80 has a collector 82, a base 84, and an emitter 86. The shutdown 110 causes the circuit 60 to terminate power when the voltage drops below a specified level and the reset 70 forces the shutdown to keep power terminated if the battery regenerates. The reset 70 accomplishes the continual shutdown through a capacitor 74 that keeps voltage on the base terminal 84 of the transistor 80 until the battery 30 is disconnected from the circuit 60 by the switch 40 when a charging means 20 is attached. When power is circumvented from the circuit 60 to the battery 30 by the switch 40, the capacitor 74 discharges and the reset 70 of the circuit 60 resets the shutdown 110 allowing the light bulb 12 to operate.

Operation

When the battery 30 is fully charged, the power management system 50 allows power to flow to the light bulb 12. The power management system 50 also allows the battery 30 to discharge until the battery reaches 5% state of charge (SOC) or 95% depth of discharge (DOD). The termination of power output by the power management circuit 60 at the specified level and/or with an unacceptable range prevents the battery 30 from degenerating.

Specifically, the power termination occurs when the base 126 of the shutdown transistor 120 receives about 1.1 V or less. At this level the shutdown transistor 120 no longer allows voltage to flow from the collector 128 to the emitter 132 on the shutdown transistor. The lack of power flowing into the collector 128 on the shutdown transistor 120 activates the collector 156 on the level shifter transistor 150, which normally gives a positive charge to the gate 106 on the FET 100, by changing the voltage to zero. When the collector 156 on the level shifter transistor 150 has no voltage, the gate 106 on the FET 100 is switched, activating the disconnect 90 and terminating power output to the light bulb 12.

The capacitor 94 in parallel with the IM resistor keeps charge on the base of the reset 80 preventing the circuit 60 from allowing power to light bulb 12 once power has been terminated. The reset is necessary to prevent the light bulb 12 from turning off and on or flickering, since the rechargeable battery 30 may regenerate and gain charge when there is no load on the battery. When the charging means 20 is plugged into the plug 44, a switch 40, normally closed, is opened causing disruption of power to the circuit 60. The capacitor 74 on the reset 70 then discharges allowing the power management system 50 to return to original operation once the charging means 20 is unplugged and the switch 40 returns to its normally closed position. The integral switch 40 on the plug 44 prevents the lantern from operating when the battery is charging.

The above description is that of a preferred embodiment of the invention. Various alterations and changes can be made without departing from the spirit and broader aspects of the invention as set forth in the appended claims, which are to be interpreted in accordance with the principles of patent law including the doctrine of equivalents.

What is claimed is:

1. A solar lantern comprising:

a light bulb;

a battery for providing power to said light bulb;

a solar panel;

connector means for releasably interconnecting said solar panel to said battery for charging said battery;

first switch means for interrupting power to said light bulb when said interconnecting means interconnects said battery and said solar panel; and second switch means for interrupting power to said light bulb when the voltage of said battery is unacceptably low.

2. The solar lantern of claim 1 wherein said second switch means interrupts the power until said first switch means is actuated.

3. The solar lantern of claim 1 wherein said solar panel is flexible.

4. A rechargeable lantern comprising:

a light bulb;

a battery providing power to said light bulb;

charger means for charging said battery;

connector means for releasably interconnecting said charger means to said battery;

first switch means for interrupting power to said light bulb when said interconnecting means interconnects said battery and said charger means; and second switch means for interrupting power to said light bulb when the voltage of said battery is unacceptably low.

5. The rechargeable lantern of claim 4 wherein said charger means comprises a solar panel.

6. The rechargeable lantern of claim 4 wherein said first switch means is actuated as said connector means interconnects said battery and said charger means.

7. A rechargeable solar lantern comprising:

a light bulb;

a battery for providing power to the light bulb;

a solar panel;

connector means for releasably interconnecting said solar panel to said battery for charging said battery; and first switch means for interrupting power to said light bulb when said connector means interconnects said battery and said solar panel.

8. The rechargeable lantern of claim 7 further comprising second switch means for interrupting power to said light bulb when the voltage of said battery is within a predetermined unacceptable range.

9. A rechargeable solar lantern comprising:

a battery;

a light bulb powered by said battery; and first switch means for interrupting power to said light bulb when the voltage of said battery is unacceptably low.

10. The rechargeable lantern of claim 9 further comprising:

a solar panel; and connector means for releasably interconnecting said solar panel and said battery.

11. The rechargeable lantern of claim 10 further comprising second switch means for interrupting power to said light bulb when said connector means interconnects said battery and said solar panel.

12. The rechargeable lantern of claim 10 wherein said first switch means interrupts power to said light bulb until said second switch means is actuated.

* * * * *